US008778578B2

(12) United States Patent
Suzuki et al.

(10) Patent No.: US 8,778,578 B2
(45) Date of Patent: Jul. 15, 2014

(54) TONER SET FOR ELECTROPHOTOGRAPHY, AND IMAGE FORMING METHOD AND APPARATUS

(75) Inventors: Kazumi Suzuki, Shizuoka (JP); Tatsuya Morita, Kanagawa (JP); Shingo Sakashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 13/527,053

(22) Filed: Jun. 19, 2012

(65) Prior Publication Data

US 2013/0017480 A1 Jan. 17, 2013

(30) Foreign Application Priority Data

Jul. 12, 2011 (JP) ..... 2011-153664

(51) Int. Cl.
*G03G 15/01* (2006.01)
*G03G 9/09* (2006.01)

(52) U.S. Cl.
USPC ..... 430/45.4; 430/107.1; 430/111.4

(58) Field of Classification Search
USPC ..... 430/107.1, 45.4, 108.21, 109.4
See application file for complete search history.

(56) References Cited

U.S. PATENT DOCUMENTS 5,736,291 A * 4/1998 Dalal et al. ..... 430/137.1
5,837,408 A * 11/1998 Parker et al. ..... 430/45.31
5,885,739 A * 3/1999 Dalal et al. ..... 430/107.1
6,066,422 A * 5/2000 Blaszak et al. ..... 430/45.4
6,248,496 B1 * 6/2001 Galloway et al. ..... 430/111.35
6,682,865 B2 * 1/2004 Viturro et al. ..... 430/45.2
6,921,616 B2 * 7/2005 Yamazaki et al. ..... 430/45.5
7,303,846 B2 * 12/2007 Sakai et al. ..... 430/107.1
7,502,582 B2 * 3/2009 Ng et al. ..... 430/45.4
7,642,023 B2 * 1/2010 Nagase et al. ..... 430/45.4
2004/0142262 A1 * 7/2004 Nakamura et al. ..... 430/107.1
2006/0198661 A1 * 9/2006 Nishihama et al. ..... 399/257
2006/0198662 A1 * 9/2006 Fukuda et al. ..... 399/257
2006/0268084 A1 * 11/2006 Nishizaki et al. ..... 347/100

(Continued)

FOREIGN PATENT DOCUMENTS

JP 59-181361 10/1984
JP 2-64651 3/1990

(Continued)

OTHER PUBLICATIONS

English language machine translation of JP 2002-372832 (Dec. 2002).*

(Continued)

*Primary Examiner* — Christopher Rodee
(74) *Attorney, Agent, or Firm* — Oblon, Spivak, McClelland, Maier & Neustadt, L.L.P.

(57) ABSTRACT

A toner set for electrophotography, including a black toner; a yellow toner; a magenta toner; a cyan toner; and a bright yellow toner, wherein the magenta toner includes a magenta colorant mainly including C.I. Pigment Red 122, the yellow toner has a hue angle of from 93 to 100° and the bright yellow toner has a hue angle of from 60 to 85° in L*a*b* color system.

8 Claims, 3 Drawing Sheets

(56) References Cited

U.S. PATENT DOCUMENTS

| | | | | |
|---|---|---|---|---|
| 2008/0038657 | A1* | 2/2008 | Yamazaki et al. | 430/120.4 |
| 2009/0291377 | A1* | 11/2009 | Hirose et al. | 430/108.21 |
| 2009/0291378 | A1* | 11/2009 | Hirose et al. | 430/107.1 |
| 2009/0305154 | A1* | 12/2009 | Lieberman | 430/42.1 |
| 2010/0226665 | A1* | 9/2010 | Yamade | 399/39 |
| 2011/0008723 | A1 | 1/2011 | Morita et al. | |
| 2011/0069336 | A1* | 3/2011 | Lin et al. | 358/1.9 |
| 2011/0076039 | A1* | 3/2011 | Nakajima | 399/39 |
| 2011/0151362 | A1* | 6/2011 | Yasukawa et al. | 430/42.1 |
| 2011/0151373 | A1* | 6/2011 | Ayaki et al. | 430/124.1 |
| 2011/0177447 | A1 | 7/2011 | Suzuki et al. | |
| 2011/0216381 | A1* | 9/2011 | Soeda et al. | 358/518 |
| 2011/0223528 | A1* | 9/2011 | Ohno et al. | 430/107.1 |
| 2012/0082926 | A1 | 4/2012 | Suzuki et al. | |
| 2012/0208119 | A1* | 8/2012 | Iwamoto et al. | 430/108.21 |
| 2012/0231385 | A1* | 9/2012 | Tamaki et al. | 430/107.1 |

FOREIGN PATENT DOCUMENTS

| | | | | |
|---|---|---|---|---|
| JP | 4-100052 | | 4/1992 | |
| JP | 2000-347476 | | 12/2000 | |
| JP | 2002372832 | A * | 12/2002 | G03G 15/01 |
| JP | 2003-215847 | | 7/2003 | |
| JP | 2004-118020 | | 4/2004 | |
| JP | 2004-142153 | | 5/2004 | |
| JP | 2006113295 | A * | 4/2006 | |
| JP | 2007-304401 | | 11/2007 | |
| JP | 2009-229989 | | 10/2009 | |
| JP | 2011-8079 | | 1/2011 | |

OTHER PUBLICATIONS

English language machine translation of JP 2006-113295 (Apr. 2006).*

* cited by examiner

TONER SET FOR ELECTROPHOTOGRAPHY, AND IMAGE FORMING METHOD AND APPARATUS

CROSS-REFERENCE TO RELATED APPLICATIONS

This patent application is based on and claims priority pursuant to 35 U.S.C. §119 to Japanese Patent Application No. 2011-153664 filed on Jul. 12, 2011, in the Japanese Patent Office, the entire disclosure of which is hereby incorporated herein by reference.

FIELD OF THE INVENTION

The present invention relates to a toner for developing an electrostatic latent image in electrophotography, electrostatic recording, electrostatic printing, etc., and to an image forming method and an image forming apparatus using the toner.

BACKGROUND OF THE INVENTION

The electrophotographic method of forming a visual image by developing an electrostatic latent image with a developer includes forming an electrostatic latent image on a photoreceptor including photoconductive material, forming a toner image by developing the electrostatic latent image with a developer including a toner, transferring the toner image onto a recording medium such as papers, and forming a fixed image thereon by fixing the toner image with heat and pressure.

The toner is typically a colored particulate material formed of a binder resin including a colorant, a charge controlling agent and other additives, and is mostly prepared by a pulverization method or a suspension polymerization method. The pulverization method includes melting, mixing and dispersing a colorant, a charge controlling agent, etc. in a thermoplastic resin to prepare a composition; and pulverizing and classifying the composition to prepare a toner.

In order to save energy and downsize a toner, which is difficult for the pulverization method, chemical toners prepared by the suspension polymerization method, an emulsion polymerization method, a dissolved resin suspension method, etc. are becoming popular.

A toner set which is a combination of a cyan toner, a magenta toner, a yellow toner which are three-color process toners and a black toner is typically used to form a full-color image by the electrophotographic method.

A developing order of the toners when forming a full-color image is not limited, but e.g., light from a document is irradiated on a photoreceptor through a color separation filter or an image read by a scanner is written with a laser irradiation on a photoreceptor to form an electrostatic yellow latent image thereon.

The electrostatic yellow latent image is developed with a yellow toner to form a yellow toner image, and which is transferred onto a recording medium such as papers.

Next, a magenta toner image, a cyan toner image and a black toner image which are similarly prepared with a magenta toner, a cyan toner and a black toner, respectively are sequentially overlapped on the yellow toner image to form a full-color image.

However, as the electrophotographic full-color image forming apparatuses become widely used, their applications multifariously expand and demands for their image quality are becoming more severe.

Copies of pictures, brochures and maps are required to very finely and faithfully reproduce the original images. Demands for color brightness are becoming high as well and color reproduction range is desired to expand.

Recently, even the electrophotographic image forming methods have been required to produce images having high-definition as good as or better than that of printed images.

Japanese published unexamined application No. 2000-343476 discloses a method of using a highly-colored toner for solid part and a low-colored toner for highlight part besides the three-color process toners to form an image.

Japanese published unexamined applications Nos. 2004-118020 and 2004-142153 disclose a method of reproducing delicate color tone using seven color toners including additional red, blue and green toners.

However, multicolor toners increases cost of preparing the toners and enlarges the apparatus, and it is reasonable to increase only one color. Japanese published unexamined applications Nos. 2007-304401 and 2011-008079 discloses an orange color toner, which is difficult for the three-color process toners to reproduce. However, improvement of blue color reproducibility which is difficult for the three-color process toners to reproduce as well is not expected.

Because of these reasons, a need exist for a four-color process toner set producing images having maximum color reproducibility with only one additional color toner.

SUMMARY OF THE INVENTION

Accordingly, one object of the present invention to provide a four-color process toner set producing images having maximum color reproducibility with only one additional color toner.

Another object of the present invention to provide an image forming method using the toner set.

A further object of the present invention to provide an image forming apparatus using the toner set.

These objects and other objects of the present invention, either individually or collectively, have been satisfied by the discovery of a toner set for electrophotography, comprising:

a black toner;

a yellow toner;

a magenta toner;

a cyan toner; and a bright yellow toner, wherein the magenta toner comprises a magenta colorant mainly comprising C.I. Pigment Red 122, the yellow toner has a hue angle of from 93 to 100° and the bright yellow toner has a hue angle of from 60 to 85° in L*a*b* color system.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
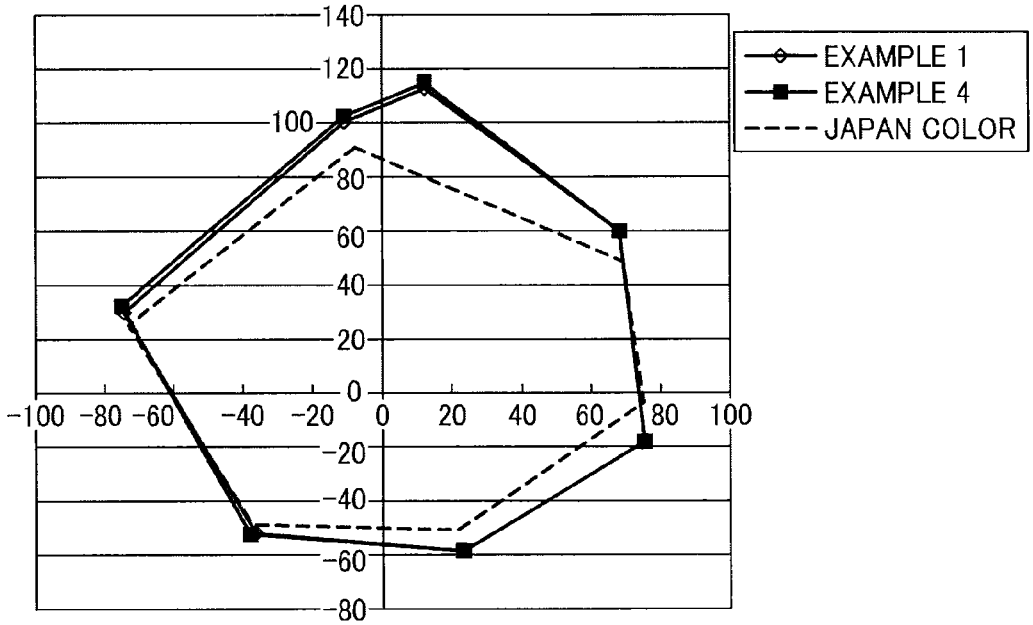
FIG. 1 is a diagram comparing a color reproduction range of a*b* surface of a color image formed by each of developer sets prepared in Examples 1 and 4 with Japan color.

The present invention provides a four-color process toner set producing images having maximum color reproducibility with only one additional color toner.

More particularly, the present invention relates to a toner set for electrophotography, comprising:

a black toner;

a yellow toner;

a magenta toner;

a cyan toner; and a bright yellow toner, wherein the magenta toner comprises a magenta colorant mainly comprising C.I. Pigment Red 122, the yellow toner has a hue angle of from 93 to 100° and the bright yellow toner has a hue angle of from 60 to 85° in L*a*b* color system.

The magenta colorant includes C.I. Pigment Red 122 in an amount not less than 60% by weight.

The magenta colorant preferably has a hue angle of from 340 to 352°, and more preferably from 345 to 352° in L*a*b* color system because second colors red and blue both have high saturation.

C.I. Pigment Red 122 is a typical magenta colorant having good light resistance. C.I. Pigment Red 122 has a small absorbance of blue light having a wavelength of from 380 to 420 nm, and sufficiently produces blue as a second color. Due to problems mentioned later, C.I. Pigment Red 122 is typically mixed with C.I. Pigment Red 269, C.I. Pigment Red 150, C.I. Pigment Red 48:3, etc., but when the content of C.I. Pigment Red 122 is less than 60% by weight, it has larger absorbance of blue light having a wavelength of from 380 to 420 nm and does not sufficiently produce blue. The content of C.I. Pigment Red 122 is preferably not less than 80% by weight to produce brighter blue.

However, C.I. Pigment Red 122 has low colorability, and particularly has a small absorbance around 500 nm and reflected green light decreases res saturation as a second color. Particularly, electrophotographic image formation is basically a digital image forming process and different from an image forming process such as an inkjet capable of forming multivalued images, and cannot complement by increasing an adherence amount of the colorant.

Therefore, a toner including a bright yellow colorant absorbing light having a wavelength around 500 nm and having a hue angle of from 60 to 85° in L*a*b* color system. Red reproduced by the bright yellow toner and the magenta toner does not reflect green light and has high saturation.

The bright yellow colorant preferably includes C.I. Pigment Yellow 139 or 181 in an amount not less than 50% by weight, and more preferably C.I. Pigment Yellow 139 or 181 is used alone.

Specific examples of the yellow toner colorants include C.I. Pigment Yellow 74, C.I. Pigment Yellow 155, C.I. Pigment Yellow 180, C.I. Pigment Yellow 185, C.I. Pigment Yellow 17, etc. Particularly, C.I. Pigment Yellow 185 is preferably used because of its safety, hue, colorability and good green color reproduction range. Even in the process of preparing a chemical toner in which a pigment is difficult to disperse, C.I. Pigment Yellow 185 is stably dispersed with the same dispersant used to disperse C.I. Pigment Yellow 139 used in the bright yellow toner because of having a skeleton close to that of C.I. Pigment Yellow 139.

Specific examples of the cyan toner colorants include, but are not limited to, C.I. Pigment Blue 15:3 and C.I. Pigment Blue 15:4.

A carbon black is typically used as the black toner colorant and the cyan toner colorant is occasionally mixed therewith when necessary.

Besides the bright yellow toner, special color toners such as a transparent toner, a white toner, a gray toner, a light yellow toner, a light magenta toner, a light cyan toner, a fluorescent color toner, a metallic toner and a pearl color toner are occasionally used in the image forming apparatus of the present invention. These additional toners can form an image which has not ever been produced. Particularly, the transparent toner without a colorant can make a specific surface treatment such as water marks and gloss modulation.

The toner preferably includes the colorant in an amount of from 3 to 15%, and more preferably from 5 to 12% by weight, depending on its colorability, though. When less than 3% by weight, the toner has insufficient colorability and wastefully adheres to an image. When greater than 15% by weight, the toner is difficult to have stable chargeability.

The colorant preferably has a particle diameter not greater than 150 nm, and more preferably not greater than 100 nm. When greater than 150 nm, the toner deteriorates in colorability and transparency, and has insufficient color reproduction range.

The colorant is dispersed by a method of mixing and kneading a resin and the colorant with a high shearing strength or a method of preliminarily dispersing a dispersant and the colorant in a solvent, but the methods are not limited thereto. High shearing dispersers such as three-roll mills and open two-rolls are preferably used to mix and knead the colorant. Beads mills and nanomizers from YOSHIDA KIKAI CO., LTD. are preferably used to disperse the colorant in a chemical toner.

The particle diameter and dispersion status of the colorant in a toner can be observed by a TEM. A toner is buried in an epoxy resin and a slice sample formed by ultrasonic is observed.

The binder resins are not particularly limited, and conventionally-used resins can be used alone or in combination. The binder resin preferably includes a gel component insoluble in the solvent in an amount less than 0 5%. A fixed image has low glossiness and deteriorates in color reproducibility with the gel component. In addition, the resin composition can control the shape of a toner, and locations of a wax and a pigment therein.

Specific examples of the resins include vinyl polymers including styrene monomers, acrylic monomers or methacrylic monomers, or copolymers including two or more of the monomers; polyester polymers; a polyol resin; a phenol resin; a silicone resin; a polyurethane resin; a polyamide resin; a furan resin; an epoxy resin; a xylene resin; a terpene resin; a coumarone-indene resin; a polycarbonate resin; a petroleum resin; etc.

Specific examples of the styrene monomers include styrenes or their derivatives such as styrene, o-methylstyrene, m-methylstyrene, p-methylstyrene, p-phenylstyrene, p-ethylstyrene, 2,4-dimethylstyrene, p-n-butylstyrene, p-tert-butylstyrene, p-n-hexylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dochlorostyrene, m-nitrostyrene, o-nitrostyrene and p-nitrostyrene.

Specific examples of the acrylic monomers include an acrylic acid or their esters such as methylacrylate, ethylacrylate, n-butylacrylate, isobutylacrylate, n-octylacrylate, n-dodecylacrylate, 2-ethylhexylacrylate, stearylacrylate, 2-chloroethylacrylate and phenylacrylate.

Specific examples of the methacrylic monomers include a methacrylic acid or their esters such as a methacrylic acid, methylmethacrylate, ethylmethacrylate, propylmethacrylate, n-butylmethacrylate, isobutylmethacrylate, n-octylmethacrylate, n-dodecylmethacrylate, 2-ethylhexylmethacrylate, stearylmethacrylate, phenylmethacrylate, dimethylaminoethylmethacrylate and diethylaminoethylmethacrylate.

Specific examples of other monomers forming the vinyl polymers or copolymers include the following materials (1) to (18):

(1) monoolefins such as ethylene, propylene, butylene and isobutylene; (2) polyenes such as butadiene and isoprene; (3) halogenated vinyls such as vinylchloride, vinylidenechloride, vinylbromide and vinylfluoride; (4) vinyl esters such as vinylacetate, vinylpropionate and vinylbenzoate; (5) vinylethers such as vinylmethylether, vinylethylether and vinylisobutylether; (6) vinylketones such as vinylmethylketone, vinylhexylketone and methyl isopropenylketone; (7) N-vinyl compounds such as N-vinylpyrrole, N-vinylcarbazole, N-vinylindole and N-vinylpyrrolidone; (8) vinylnaphthalenes; (9) acrylic acid or methacrylic acid derivatives such as acrylonitrile, methacrylonitrile and acrylamide; (10) unsaturated diacids such as a maleic acid, a citraconic acid, an itaconic acid, an alkenylsuccinic acid, a fumaric acid and a mesaconic acid; (11) unsaturated diacid anhydrides such as a maleic acid anhydride, a citraconic acid anhydride, an itaconic acid anhydride and an alkenylsuccinic acid anhydride; (12) monoesters of unsaturated diacids such as monomethylester maleate, monoethylester maleate, monobutylester maleate, monomethylester citraconate, monoethylester citraconate, monobutylester citraconate, monomethylester itaconate, monomethylester alkenylsuccinate, monomethylester fumarate and monomethylester mesaconate; (13) esters of unsaturated diacids such as a dimethyl maleic acid and a dimethyl fumaric acid; (14) α,β-unsaturated acids such as a crotonic acid and a cinnamic acid; (15) α,β-unsaturated acid anhydrides such as crotonic acid anhydride and a cinnamic acid anhydride; (16) monomers having a carboxyl group, such as anhydrides of the α,β-unsaturated acids and lower fatty acids, an alkenylmalonic acid, alkenylglutaric acid alkenyladipic acid, their anhydrides and monoesters; (17) hydroxyalkylester acrylates or methacrylates such as 2-hydroxyethylacrylate, 2-hydroxyethylmethacrylate and 2-hydroxypropylmethacrylate; and (18) monomers having a hydroxy group such as 4-(1-hydroxy-1-methylbutyl)styrene and 4-(1-hydroxy-1-methylhexyl)styrene.

The vinyl polymer or copolymer of the binder resin may have a crosslinked structure formed by a crosslinker having 2 or more vinyl groups. Specific examples of the crosslinker include aromatic divinyl compounds such as divinylbenzene and divinylnaphthalene; diacrylate compounds bonded with an alkyl chain, such as ethyleneglycoldiacrylate, 1,3-butyleneglycoldiacrylate, 1,4-butanedioldiacrylate, 1,5-pentanedioldiacrylate, 1,6-hexanedildiacrylate, neopentylglycoldiacrylate or their dimethacrylates.

Specific examples of diacrylate compounds bonded with an alkyl chain including an ester bond include as diethyleneglycoldiacrylate, triethyleneglycoldiacrylate, tetraethyleneglycoldiacrylate, polyethyleneglycoldiacrylate#400, polyethyleneglycoldiacrylate#600, dipropyleneglycoldiacrylate or their dimethacrylates.

Diacrylate or dimethacrylate compounds bonded with a chain including an aromatic group and an ether bond can also be used. Polyester diacrylates include a product named MANDA from NIPPON KAYAKU CO., LTD.

Specific examples of a multifunctional crosslinker include pentaerythritoltriacrylate, trimethylolethanetriacrylate, trimethylolpropanetriacrylate, tetramethylolmethanetetraacrylate, oligoesteracrylate and their methacrylates, triallylcyanurate and triallyltrimellitate.

The toner preferably includes the crosslinker in an amount of 0.001 to 10 parts by weight, more preferably from 0.03 to 5 parts by weight based on total weight of the monomer. Among these crosslinking monomers, the aromatic divinyl compounds, particularly the divinylbenzene and the diacrylate compounds bonded with a bonding chain including an aromatic group and an ether bond are preferably used in terms of the fixability and offset resistance of the resultant toner. Further, styrene copolymers and styrene-acrylic copolymers are more preferably used.

Specific examples of polymerization initiators used for preparing the vinyl polymer or copolymer include azo polymerization initiators such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutylate, 1,1'-azobis(cyclohexanecarbonitrile), 2-(carbamoylazo)-isobutyronitrile, 2,2'-azobis(2,4,4-trimethylpentane), 2-phenylazo-2',4'-fimethyl-4'-methoxyvaleronitrile and 2,2'-azobis(2-methylpropane); ketone peroxides such as methyl ethyl ketone peroxide, acetylacetone peroxide and cyclohexanone peroxide; 2,2-bis(tert-butylperoxy)butane; tert-butylhydroperoxide; cumenehydroperoxide; 1,1,3,3-tetramethylbutylhydroperoxide; di-tert-butylperoxide; tert-butylcumylperoxide; di-cumylperoxide; α-(tert-butylperoxy)isopropylbenzene; isobutylperoxide; octanoylperoxide; decanoylperoxide; lauroylperoxide; 3,5,5-trimethylhexanoylperoxide; benzoylperoxide; m-tolylperoxide; di-isopropylperoxydicarbonate; di-2-ethylhexylperoxydicarbonate; di-n-propylperoxydicarbonate; di-2-ethoxyethylperoxycarbonate; di-ethoxyisopropylperoxydicarbonate; di(3-methl-3-methoxybutyl)peroxycarbonate; acetylcyclohexylsulfonylperoxide; tert-butylperoxyacetate; tert-butylperoxyisobutylate; tert-butylperoxy-2-ethylhexalate; tert-butylperoxylaurate; tert-butyloxybenzoate; tert-butylperoxyisopropylcarbonate; di-tert-butylperoxyisophthalate; tert-butylperoxyallylcarbonate; isoamylperoxy-2-ethylhexanoate; di-tert-butylperoxyhexahydroterephthalate; tert-butylperoxyazelate; etc.

When the binder resin is selected from styrene-acrylic resins, the binder resin preferably includes elements soluble with tetrahydrofuran (THF), having a weight-average molecular weight of from $8.0\times10^3$ to $5.0\times10^4$ in a molecular weight distribution by GPC thereof in terms of the fixability, offset resistance and storage stability of the resultant toner. When less than $8.0\times10^3$, the residual solvent can be reduced but the offset resistance and storage stability of the resultant toner deteriorate. When greater than $5.0\times10^4$, it is difficult to make the residual solvent value not greater than 200 ppm.

When the binder resin is selected from vinyl polymers such as styrene-acrylic resins, the binder resin preferably has an acid value of from 0.1 to 100 mg KOH/g, more preferably from 0.1 to 70 mg KOH/g, and much more preferably from 0.1 to 50 mg KOH/g.

Specific examples of monomers forming polyester polymers include the following materials.

Specific examples of bivalent alcohol include diols such as ethyleneglycol, propyleneglycol, 1,3-butanediol, 1,4-butanediol, 2,3-butanediol, 1,4-butenediol, diethyleneglycol, triethyleneglycol, 1,5-pentanediol, 1,6-hexanediol, neopentylglycol, 2-ethyl-1,3-hexanediol, and diols formed by polymerizing hydrogenated bisphenol A or bisphenol A with cyclic ethers such as an ethylene oxide and a propylene oxide.

In order to crosslink polyester resins, alcohol having 3 valences or more is preferably used together.

Specific examples of polyalcohol having 3 or more valences include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxybenzene, etc.

Specific examples of acids forming the polyester polymers include benzene dicarboxylic acids or their anhydrides such as a phthalic acid, an isophthalic acid and a terephthalic acid; alkyl dicarboxylic acids or their anhydrides such as a succinic acid, an adipic acid, a sebacic acid and an azelaic acid; unsaturated diacids such as a maleic acid, a citraconic acid, an itaconic acid, an alkenylsuccinic acid, a fumaric acid and a mesaconic acid; and unsaturated diacid anhydrides such as a maleic acid anhydride, a citraconic acid anhydride, an itaconic acid anhydride and an alkenylsuccinic acid anhydride; etc. Specific examples of polycarboxylic acids having 3 or more valences include a trimellitic acid, a pyromellitic acid, a 1,2,4-benzenetricarboxylic acid, a 1,2,5-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, a 1,3-dicarboxyl-2-methylmethylenecarboxypropane, tetra(methylenecarboxyl)methane, 1,2,7,8-octantetracarboxylic acids, empol trimer or their anhydrides, or those partially replaced with lower alkyl esters, etc.

When the binder resin is selected from polyester resins, the binder resin preferably includes elements soluble with tetrahydrofuran (THF), having a weight-average molecular weight of from $8.0\times10^3$ to $5.0\times10^4$ in a molecular weight distribution by GPC thereof in terms of the fixability, offset resistance and storage stability of the resultant toner. When less than $8.0\times10^3$, the residual solvent can be reduced but the offset resistance and storage stability of the resultant toner deteriorate. When greater than $5.0\times10^4$, it is difficult to make the residual solvent value not greater than 200 ppm.

When the binder resin is selected from polyester resins, the binder resin preferably has an acid value of from 0.1 to 100 mg KOH/g, more preferably from 5 to 70 mg KOH/g, and much more preferably from 10 to 50 mg KOH/g.

In the vinyl polymers and/or polyester resins, resins including monomers reactable therewith can be used. Specific examples of the monomers forming the polyester resin, reactable with the vinyl polymer include unsaturated dicarboxylic acids or their anhydrides such as a phthalic acid, a maleic acid, a citraconic acid and an itaconic acid. Specific examples of the monomers forming the vinyl polymer include monomers having a carboxyl group or a hydroxy group, and an acrylic acid or ester methacrylates.

When the polyester polymer, vinyl polymer and other binder resins are used together, the united resins preferably includes resins having an acid value of from 0.1 to 50 mgKOH/g in an amount of 60% by weight.

The binder resin and compositions including the binder resin of the toner preferably has a glass transition temperature of from 35 to 80° C., and more preferably from 40 to 75° C. in terms of the storage stability of the resultant toner. When lower than 35° C., the resultant toner is likely to deteriorate in an environment of high temperature, and have offset problems when fixed. When higher than 80° C., the fixability thereof occasionally deteriorates.

The toner of the present invention is preferably a toner prepared by dispersing an oil phase including at least a crystalline polyester resin (or its precursor) as a binder resin in an organic solvent in an aqueous medium to prepare an O/W dispersion, and removing the organic solvent therefrom.

The binder resin precursor is preferably formed of a modified polyester resin, and includes a polyester prepolymer modified by isocyanate and epoxy. This has an elongation reaction with a compound having an active hydrogen group such as amines to improve release width (a difference between the fixable minimum temperature and the hot offset occurrence temperature).

The polyester prepolymer can be synthesized by reacting known isocyanating agents or epoxidizers with a base polyester resin.

Specific examples of the isocyanating agents include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as $\alpha,\alpha,\alpha',\alpha'$-tetramethylxylylenediisocyanate; isocyanurate; the above-mentioned polyisocyanate blocked with phenol derivatives, oxime and caprolactam; and their combinations.

Specific examples of the epoxidizers include epichlorohydrine.

The isocyanating agent is mixed with polyester such that an equivalent ratio ([NCO]/[OH]) between an isocyanate group [NCO] and polyester having a hydroxyl group [OH]is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

The content of the isocyanating agent in the polyester prepolymer is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. When greater than 40% by weight, low-temperature fixability of the resultant toner deteriorates.

The number of the isocyanate group included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

The binder resin precursor preferably has a weight-average molecular weight of from $1\times10^4$ to $3\times10^5$.

Specific examples of compounds elongating or crosslinking with the binder resin precursor include a compound having an active hydrogen group such as amines.

Specific examples of the amines include diamines, polyamines having three or more amino groups, amino alcohols, amino mercaptans, amino acids and blocked amines in which the amines mentioned above are blocked.

Specific examples of the diamines include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc.

Specific examples of the polyamines having three or more amino groups include diethylene triamine, triethylene tetramine.

Specific examples of the amino alcohols include ethanol amine and hydroxyethyl aniline.

Specific examples of the amino mercaptan include aminoethyl mercaptan and aminopropyl mercaptan.

Specific examples of the amino acids include amino propionic acid and amino caproic acid. Specific examples of the blocked amines include ketimine compounds which are prepared by reacting one of the amines mentioned above with a ketone such as acetone, methyl ethyl ketone and methyl isobutyl ketone; oxazoline compounds, etc. Among these compounds, diamines and mixtures in which a diamine is mixed with a small amount of a polyamine are preferably used.

In the present invention, an amorphous unmodified polyester resin can be used as the binder resin.

It is preferable that the modified polyester resin prepared by crosslinking and/or elongating the binder resin precursor formed of the modified polyester resins and the unmodified polyester resin are at least partially compatible, which improves low-temperature fixability and hot offset resistance of the resultant toner. Therefore, polyols and polycarboxylic acids forming the modified polyester resin and the unmodified polyester resin preferably have similar compositions.

The crystalline polyester resin can be dispersed and included in the toner of the present invention. Having crystallinity, the crystalline polyester resin quickly decreases viscosity around an endothermic peak temperature. Namely, just before a melt starting temperature, the crystalline polyester resin has good thermostability, and quickly decreases viscosity (has sharp meltability) at the melt starting temperature and fixed. Therefore, the crystalline polyester resin forms a toner having both good thermostability and low-temperature fixability.

A toner including the crystalline polyester resin having a sharp endothermic curve and an endothermic peak at from 60 to 100° C., preferably from 65 to 75° C. has better low-temperature fixability and thermostability.

Specific examples of the crystalline polyester resins include those obtained by synthesizing alcoholic components such as saturated aliphatic diol compounds having 2 to 12 carbon atoms, particularly 1,4-butanediol, 1,6-hexanediol, 1,8-octanediol, 1,10-decanediol, 1,12-dodecanediol and their derivatives; and acidic components such as saturated dicarboxylic acids, particularly, fumaric acid, 1,4-butanediacid, 1,6-hexanediacid, 1,8-ocatnediacid, 1,10-decanediacid, 1,12-dodecanediacid and their derivatives.

Among these alcoholic components and acidic components, in terms of make a difference between an endothermic peak temperature and an endothermic shoulder temperature smaller, the crystalline polyester resin is preferably synthesized with only one of alcoholic components of 1,4-butanediol, 1,6-hexanediol, 1,8-octanediol, 1,10-decanediol, 1,12-dodecanediol and one of dicarboxylic acids of fumaric acid, 1,4-butanediacid, 1,6-hexanediacid, 1,8-ocatnediacid, 1,10-decanediacid, 1,12-dodecanediacid.

The toner of the present invention may include an organic low-molecular-weight material besides the colorant and the binder resin to have various capabilities. Specific examples of the organic low-molecular-weight material include aromatic acid esters such as a fatty acid ester and a phthalic acid; phosphate ester; maleic acid ester; fumaric acid ester; itaconic acid ester; other esters; ketones such as benzyl, benzoin compounds and benzoyl compounds; hindered phenol compounds; benzotriazole compounds; aromatic sulfonamide compounds; fatty amide compounds; long-chain alcohols; long-chain dialcohols; long-chain carboxylic acids; long-chain dicarboxylic acids; etc.

These specifically include dimethylfumarate, monoethylfumarate, monobutylfumarate, monomethylitaconate, diphenyladipate, dibenzylterephthalate, dibenzylisophthalate, benzyl, benzoinisopropylether, 4-benzoylbiphenyl, 4-benzoyldiphenylether, 2-benzoylnaphthalene, dibenzoylmethane, 4-biphenylcarboxylic acid, stearyl amide stearate, oleyl amide stearate, stearic amide oleate, octadecanol, n-octylalcohol, tetracosanoic acid, eicosanoic acid, stearic acid, lauric acid, nonadecanoic acid, palmitic acid, hydroxy octanoic acid, docosanoic acid, the compounds disclosed in Japanese published unexamined application No. 2002-105414, having the formulae (1) to (17), etc.

Further, natural waxes, e.g., plant waxes such as carnauba wax, cotton wax, Japan wax and rice wax; animal waxes such as bees wax and lanolin; mineral waxes such as ozokerite and ceresin; petroleum waxes such as paraffin, microcrystalline and petrolatum can also be included in the toner constituents. Further, fatty acid amides such as hydroxy stearic acid amide, stearic acid amide, acid phthalic anhydride amide and chlorinated hydrocarbon; homopolymers of polyacrylate which are low-molecular-weight crystalline polymeric resins such as poly-n-stearylmethacrylate and poly-n-laurylmethacrylate or copolymer of the polyacrylate such as n-stearylacrylate-ethylmethacrylate copolymer; crystalline polymers having long side-chain alkyl groups; etc. can also be used.

These can be used alone or in combination.

When a resin and the organic low-molecular-weight material are compatible at a temperature not lower than a melting point of the organic low-molecular-weight material, the organic low-molecular-weight material works as a plasticizer. Namely, the organic low-molecular-weight material improves a softening point of the resin such that the resultant toner has good low-temperature fixability. In this case, the organic low-molecular-weight material preferably has a melting point not higher than 120° C., and more preferably not higher than 80° C. When higher than 120° C., low-temperature fixability of the resultant toner is not improved.

When the resin and the organic low-molecular-weight material are not compatible, the organic low-molecular-weight material works as a release agent. In this case, the organic low-molecular-weight material preferably has a melting point not higher than 100° C., and more preferably not higher than 80° C. When higher than 100° C., cold offset is likely to occur when toner images are fixed.

The organic low-molecular-weight material preferably has a melting viscosity of from 5 to 1,000 cps, and more preferably from 10 to 100 cps at a temperature higher than a melting point thereof by 10° C.

When less than 5 cps, the releasability of the resultant toner occasionally deteriorates. When greater than 1,000 cps, it is likely that the hot offset resistance and low-temperature fixability of the resultant toner are not improved.

Other than the resin, organic low-molecular-weight material and colorant, an inorganic particulate material can be externally added to a toner to impart fluidity, developability and chargeability thereto.

Specific examples of the inorganic particulate material include known materials such as, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

The inorganic particulate material preferably has a primary particle diameter of from 5 nm to 2 μm, and more preferably from 5 nm to 500 nm.

The inorganic particulate material is preferably included in a toner in an amount of from 0.01 to 5% by weight, and more preferably from 0.01 to 2.0% by weight based on total weight of the toner.

The surface of the inorganic particulate material can be treated with a fluidity improver to increase the hydrophobicity to prevent deterioration of fluidity and chargeability even in an environment of high humidity of the resultant toner. Specific examples of the surface treatment agent include a silane coupling agent, a sililating agent, a silane coupling agent having an alkyl fluoride group, an organic titanate coupling agent, an aluminum coupling agent a silicone oil and a modified silicone oil. The surfaces of the silica and the titanium oxide are preferably treated with the fluidity improver and used as hydrophobic silica and hydrophobic titanium oxide, respectively.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particulate materials prepared by a soap-free emulsifying polymerization method such as a polymethylmethacrylate particulate material and a polystyrene particulate material. The polymer particulate materials comparatively have a narrow particle diameter distribution and preferably have a volume-average particle diameter of from 0.01 to 1 μm.

Specific examples of charge controlling agents include any known charge controlling agents, preferably colorless or almost white materials because of not changing the color tone of the toner, such as Nigrosine dyes, triphenylmethane dyes, metal complex dyes including chromium, molybdic acid chelate pigments, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, and metal salts of salicylic acid and of salicylic acid derivatives. These can be used alone or in combination.

Specific examples of marketed products of the charge controlling agents include a quaternary ammonium salt BONTRON P-51, a metal complex of oxynaphthoic acids E-82, a metal complex of salicylic acids E-84 and a phenolic condensation product E-89, which are manufactured by Orient Chemical Industries Co., Ltd.; molybdenum complex of quaternary ammonium salts TP-302 and TP-415, which are manufactured by Hodogaya Chemical Co. Ltd.; a quaternary ammonium salt COPY CHARGE PSY VP2038, a triphenylmethane derivative COPY BLUE, quaternary ammonium salts COPY CHARGE NEG VP2036 and NX VP434, which are manufactured by Hoechst AG; LRA-901 and a boron complex LR-147, which are manufactured by Japan Carlit Co., Ltd.; quinacridone; azo pigments; polymeric compounds having functional groups such as a sulfonic acid group, a carboxyl group and a quaternary ammonium salt; etc.

The content of the charge controlling agent is determined depending on the species of the binder resin used, whether or not an additive is added and toner manufacturing method (such as dispersion method) used, and is not particularly limited. However, the content thereof is typically from 0.1 to 10 parts by weight, and preferably from 0.2 to 5 parts by weight, per 100 parts by weight of the binder resin included in the toner. When less than 0.1 parts by weight, the chargeability of the resultant toner possibly deteriorates. When greater than 10 parts by weight, the toner has too large charge quantity, and thereby the electrostatic force of a developing roller attracting the toner increases, resulting in deterioration of the fluidity of the toner and image density of the toner images.

The toner set of the present invention ca be used as a one-component developer or in a two-component developer.

When used in the two-component developer with a magnetic carrier, the developer preferably includes the toner in an amount of from 1 to 10 parts by weight per 100 parts by weight of a carrier.

Suitable magnetic carriers include known carrier materials such as iron powders, ferrite powders, magnetite powders, magnetic resin carriers, which have a particle diameter of from about 20 to 200 μm.

A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may be included in the toner when necessary. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer without using a carrier.

The image forming apparatus of the present invention is a typical electrophotographic image forming apparatus, but includes at least an additional bright yellow color image forming means besides the ordinary four black, yellow, magenta and cyan color image forming means. This is not different from a typical tandem-type electrophotographic image forming apparatus except for including 5 image forming means above the intermediate transfer belt instead of 4.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

(Preparation of Masterbacth)

<Preparation of Yellow Masterbatch A>

One hundred (100) parts of C.I. Pigment Yellow 185 (D1155 from BASF Japan, Ltd.), 400 parts of a polyester A (mainly formed of an adduct of bisphenol A with ethylene oxide and a terephthalic acid from DIC corp., having a glass transition temperature (Tg) of 61° C. and a weight-average molecular weight (Mw) of 10,000), and 30 parts of ion-exchanged water were fully mixed in a polyethylene bag to prepare a mixture. The mixture was kneaded twice in an open-roll kneader (Kneadex from Nippon Coke & Engineering Co., Ltd.) at 90° C. at feeding side and 50° C. at discharge side of front roll, 30° C. at feeding side and 20° C. at discharge side of back roll, at 35 rpm of front roll, 31 rpm of back roll, and with a gap 0.25 mm. The kneaded mixture was pulverized by a pulverizer from Hosokawa Micron Ltd. to prepare Yellow Masterbatch A.

<Preparation of Yellow Masterbatch B>

The procedure for preparation of the Yellow Masterbatch A was repeated except for replacing C.I. Pigment Yellow 185 with C.I. Pigment Yellow 74 to prepare Yellow Masterbatch B.

<Preparation of Bright Yellow Masterbatch A>

The procedure for preparation of the Yellow Masterbatch A was repeated except for replacing C.I. Pigment Yellow 185 with C.I. Pigment Yellow 139 to prepare Bright Yellow Masterbatch A.

<Preparation of Black Masterbatch A>

The procedure for preparation of the Yellow Masterbatch A was repeated except for replacing C.I. Pigment Yellow 185 with carbon black (E400R from CABOT Corp.) to prepare Black Masterbatch A.

(Preparation of Pulverization Toner)

Each of the master batches, polyester A (RN-300 from Kao Corp.) and carnauba wax (WA-05 from CERARICA NODA Co., Ltd) were mixed according to a formulation in Table 1 to prepare a mixture. The mixture was kneaded twice in an open-roll kneader (Kneadex from Nippon Coke & Engineering Co., Ltd.) at 100° C. at feeding side and 60° C. at discharge side of front roll, 40° C. at feeding side and 30° C. at discharge side of back roll, at 35 rpm of front roll, 31 rpm of back roll, and with a gap 0.25 mm. The kneaded mixture was pulverized by a pulverizer from Hosokawa Micron Ltd., and further pulverized by a jet mill and classified to prepare a mother toner having a volume-average particle diameter (Dv) of 6.0 μm and a ratio (Dv/Dn) of the volume-average particle diameter (Dv) to a number-average particle diameter of 1.20.

Further, 1.5 parts of hydrophobized silica (FMK H2000 having a particle diameter of 10 nm from Wacker Chemical GmbH.) and 1.0 part of hydrophobized titania (MT-15OAI having a particle diameter of 15 μm from Tayca Corp.) were externally added by HENSCHEL mixer to 100 parts of each of the mother toners to prepare a pulverization toner.

In Table 1, FT represents a pulverization toner, Y, BY, M, C and B represent a yellow toner, a bright yellow toner, a magenta toner, a cyan toner and a black toner, respectively.

A, B and C represent Masterbatch A, Masterbatch b and Masterbatch C, respectively.

TABLE 1

| | FT-YA (parts) | FT-YB (parts) | FT-BY (parts) | FT-MA (parts) | FT-MB (parts) | FT-MC (parts) | FT-CA (parts) | FT-BA (parts) |
|---|---|---|---|---|---|---|---|---|
| Masterbatch | 30 | 30 | 30 | 45 | 40 | 35 | 20 | 35 |
| Polyester A | 62 | 62 | 62 | 47 | 52 | 57 | 72 | 57 |
| Wax | 8 | 8 | 8 | 8 | 8 | 8 | 8 | 8 |

<Preparation of Magenta Masterbatch A>

The procedure for preparation of the Yellow Masterbatch A was repeated except for replacing C.I. Pigment Yellow 185 with C.I. Pigment Red 122 (RTS from DIC corp.) to prepare Yellow Masterbatch B.

<Preparation of Magenta Masterbatch B>

The procedure for preparation of the Yellow Masterbatch A was repeated except for replacing 100 parts of the C.I. Pigment Yellow 185 with 80 parts of C.I. Pigment Red 122 (RTS from DIC corp.) and 20 parts of C.I. Pigment Red 269 (1022 from DIC Corp.) to prepare Magenta Masterbatch B.

<Preparation of Magenta Masterbatch C>

The procedure for preparation of the Yellow Masterbatch A was repeated except for replacing 100 parts of the C.I. Pigment Yellow 185 with 50 parts of C.I. Pigment Red 122 (RTS from DIC corp.) and 50 parts of C.I. Pigment Red 269 (1022 from DIC Corp.) to prepare Magenta Masterbatch C.

<Preparation of Cyan Masterbatch A>

The procedure for preparation of the Yellow Masterbatch A was repeated except for replacing C.I. Pigment Yellow 185 with C.I. Pigment Blue15:3 (7919 from Toyo Ink Mfg. Co., Ltd.) to prepare Cyan Masterbatch A.

(Preparation of Toner by Solution Suspension Method)

[Preparation of Wax Dispersion A]

Next, a dispersion including a binder resin and a wax having the following composition was prepared.

One hundred (100) of polyester B (SREX-005L having a Tg of 58° C. and a Mw of 7.600 from Sanyo Chemical Industries, Ltd.), 90 parts of a paraffin wax (HPE-11) and 10 parts of a maleic-acid-modified paraffin wax (P-166) were stirred and dispersed in 300 parts of ethylacetate in a mixer having a stirring blade for 10 min, and further dispersed by DYNO-MILL for 8 hrs to prepare a [wax dispersion A].

[Preparation of Toner Composition Liquid]

Each of the masterbatches and the wax dispersion were dissolved and dispersed in a mixer having a stirring blade according to a formulation in Table 2 to prepare a dispersion. The dispersion was further dispersed by a beads mill (Ultra Visco Mill from IMECS CO., LTD.) for 3 passes under the following conditions to prepare a material solution:

liquid feeding speed of 1 kg/hr; peripheral disc speed of 6 m/sec; and filling zirconia beads having diameter of 0.5 mm for 80% by volume.

TABLE 2

| | CT-YA (parts) | CT-YB (parts) | CT-BY (parts) | CT-MA (parts) | CT-MB (parts) | CT-MC (parts) | CT-CA (parts) | CT-BA (parts) |
|---|---|---|---|---|---|---|---|---|
| Masterbatch | 30 | 30 | 30 | 45 | 40 | 35 | 20 | 35 |
| Polyester B | 58 | 58 | 58 | 43 | 48 | 53 | 68 | 53 |
| Wax dispersion A | 30 | 30 | 30 | 30 | 30 | 30 | 30 | 30 |
| Ethylacetate | 82 | 82 | 82 | 82 | 82 | 82 | 82 | 82 |

In Table 2, CT represents a chemical toner and others are same as those of the pulverization toner.

[Preparation of Particulate Resin Dispersion)

683 parts of water, 11 parts of a sodium salt of an adduct of a sulfuric ester with ethyleneoxide methacrylate (ELEMINOL RS-30 from Sanyo Chemical Industries, Ltd.), 79 parts of styrene, 79 parts of methacrylate, 105 parts of butylacrylate, 13 parts of divinylbenzene and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted at 75° C. for 5 hrs to prepare an aqueous dispersion (a particulate resin dispersion) of a vinyl resin (a copolymer of a sodium salt of an adduct of styrene-methacrylate-butylacrylate-sulfuric ester with ethyleneoxide methacrylate).

The [particulate resin dispersion] had a volume-average particle diameter of 105 nm when measured by LA-920. The [particulate resin dispersion] was partially dried to isolate a resin. The resin had a Tg of 95° C., a number-average molecular weight of 140,000 and weight-average molecular weight of 980,000.

[Preparation of Aqueous Medium]

Three hundred and six (306) parts of ion-exchange water, 60 parts of the particulate resin dispersion and 4 parts of sodium dodecylbenzenesulfonate were mixed while stirred such that the solid contents were uniformly dissolved to prepare an aqueous medium.

[Preparation of Emulsion or Dispersion,]

Two hundred (200) parts of the aqueous medium were placed in a container and stirred by T.K. Homomixer at 10,500 rpm, and 100 parts of the toner composition liquid were added therein and mixed for 2 min, and dispersed at 4,500 rpm for a time needed to prepare an emulsion or a dispersion (an emulsified slurry) having a volume-average particle diameter (Dv) of 6.0 μm and Dv/Dn of 1.15±0.2.

[Removal of Organic Solvent]

One hundred (100) parts of the emulsified slurry were placed in a flask including a stirrer and a thermometer, and after a solvent was removed therefrom at 30° C. for 12 hrs while stirred at a peripheral speed of 20 m/min to prepare a dispersion slurry.

[Washing & Drying]

After 100 parts of the dispersion slurry was filtered under reduced pressure, 100 parts of ion-exchange water were added to the filtered cake and mixed by T.K. Homomixer at 12,000 rpm for 10 min, and the mixture was filtered.

Three hundred (300) parts of ion-exchange water were added to the filtered cake and mixed by T.K. Homomixer at 12,000 rpm for 10 min, and the mixture was filtered. This operation was repeated again.

Twenty (20) parts of aqueous sodium hydroxide having a concentration of 10% by weight were added to the filtered cake and mixed by T.K. Homomixer at 12,000 rpm for 30 min, and the mixture was filtered under reduced pressure.

Three hundred (300) parts of ion-exchange water were added to the filtered cake and mixed by T.K. Homomixer at 12,000 rpm for 10 min, and the mixture was filtered.

Three hundred (300) parts of ion-exchange water were added to the filtered cake and mixed by T.K. Homomixer at 12,000 rpm for 10 min, and the mixture was filtered. This operation was repeated again.

Twenty (20) parts of hydrochloric acid having a concentration of 10% by weight were added to the filtered cake and mixed by T.K. Homomixer at 12,000 rpm for 30 min, and the mixture was filtered.

Three hundred (300) parts of ion-exchange water were added to the filtered cake and mixed by T.K. Homomixer at 12,000 rpm for 10 min, and the mixture was filtered. This operation was repeated again to prepare a final filtered cake.

The final filtered cake was dried by an air drier at 45° C. for 48 hrs, and sieved with a mesh having an opening of 75 μm to prepare mother toner particles.

Further, 1.5 parts of hydrophobized silica (HDK H2000 having a particle diameter of 10 nm from Wacker Chemical GmbH.) and 1.0 part of hydrophobized titania (MT-15OAI having a particle diameter of 15 μm from Tayca Corp.) were externally added by HENSCHEL mixer to 100 parts of each of the mother toner particles to prepare chemical toners CT-YA, CT-YB, CT-BY, CT-MA, CT-MB, CT-MC, CT-CA and CT-BA.

[Preparation of Carrier]

A spherical particulate ferrite having a volume-average particle diameter of 35 μm as a core material was coated with a mixture of a silicone resin and a melamine resin as a coating material to prepare a carrier.

[Preparation of Developer]

Ten (10) parts of each of the toner were uniformly mixed with 90 parts of the carrier by Tubular Mixer to prepare a two-component developer.

Five (5) or 4 color developer sets in the following Table 3 were prepared using the pulverization toners FT-YA, FT-YB, FT-BY, FT-MA, FT-MB, FT-MC, FT-CA and FT-BA and chemical toners CT-YA, CT-YB, CT-BY, CT-MA, CT-MB, CT-MC, CT-CA and CT-BA.

TABLE 3

| | Yellow | Magenta | Cyan | Black | Bright Yellow |
|---|---|---|---|---|---|
| Example 1 | FT-YA | FT-MA | FT-CA | FA-BA | FT-BY |
| Example 2 | FT-YB | FT-MA | FT-CA | FA-BA | FT-BY |
| Example 3 | FT-YA | FT-MB | FT-CA | FA-BA | FT-BY |
| Example 4 | FT-YA | CT-MA | CT-CA | CT-BA | CT-BY |
| Example 5 | CT-YB | CT-MA | CT-CA | CT-BA | CT-BY |
| Example 6 | CT-YA | CT-MB | CT-CA | CT-BA | CT-BY |
| Comparative Example 1 | FT-YA | FT-MC | FT-CA | FA-BA | None |
| Comparative Example 2 | None | FT-MA | FT-CA | FA-BA | FT-BY |

TABLE 3-continued

| | Yellow | Magenta | Cyan | Black | Bright Yellow |
|---|---|---|---|---|---|
| Comparative Example 3 | FT-YA | FT-MC | FT-CA | FA-BA | FT-BY |
| Comparative Example 4 | CT-YA | CT-MC | CT-CA | CT-BA | None |
| Comparative Example 5 | None | CT-MA | CT-CA | CT-BA | CT-BY |
| Comparative Example 6 | CT-YB | CT-MC | CT-CA | CT-BA | CT-BY |

<Evaluation>

A color chart was produced by a modified Imagio Neo C350 from Ricoh company, Ltd., which is a tandem-type full-color image forming apparatus having 5 image developers above an intermediate transfer belt on a POD gloss paper from Oji Paper Co., Ltd. with each of the two-component developer sets to evaluate color reproducibility. The adherence amount of each color was 0.35 mg/cm$^2$, and the pigment ratio was adjusted such that the color reproduction range was maximum at this adherence amount.

Figure 2:
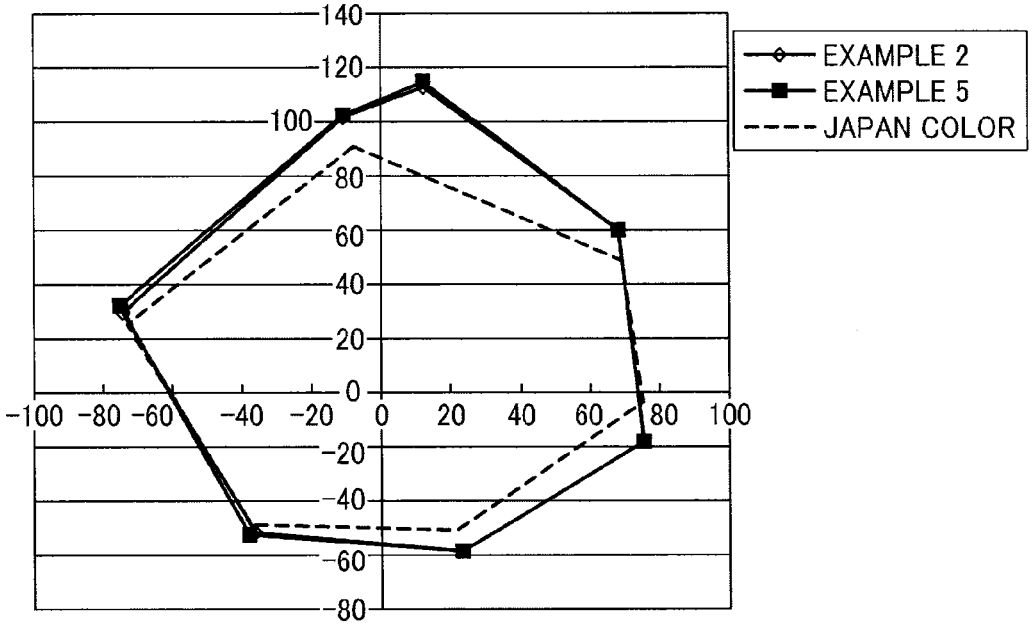
FIG. 2 is a diagram comparing a color reproduction range of a*b* surface of a color image formed by each of developer sets prepared in Examples 2 and 5 with Japan color.
Figure 3:
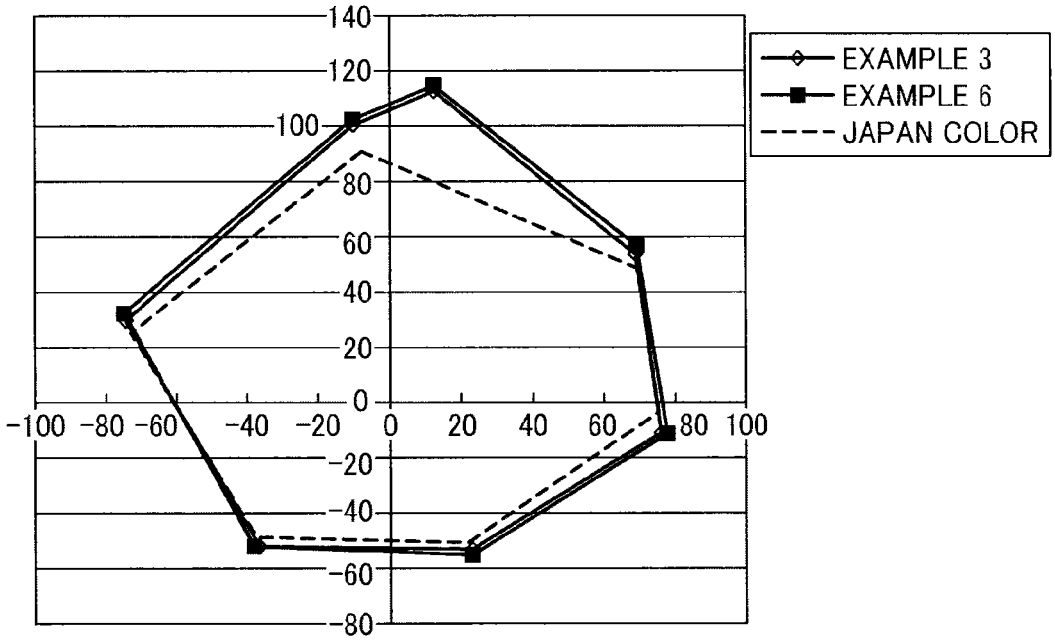
FIG. 3 is a diagram comparing a color reproduction range of a*b* surface of a color image formed by each of developer sets prepared in Examples 3 and 6 with Japan color.
Figure 4:
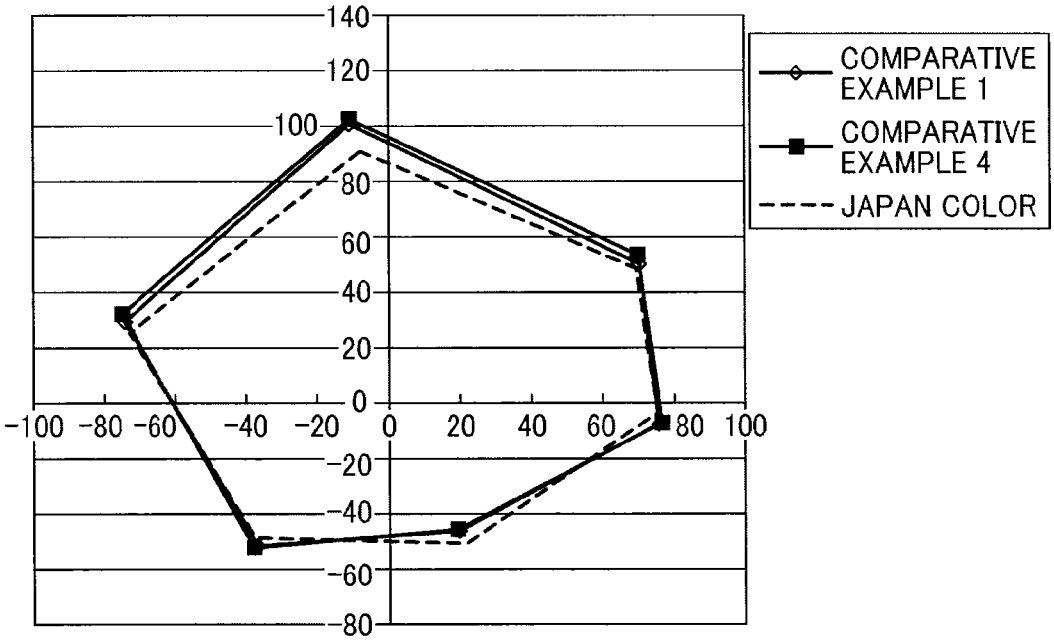
FIG. 4 is a diagram comparing a color reproduction range of a*b* surface of a color image formed by each of developer sets prepared in Comparative Examples 1 and 4 with Japan color.
Figure 5:
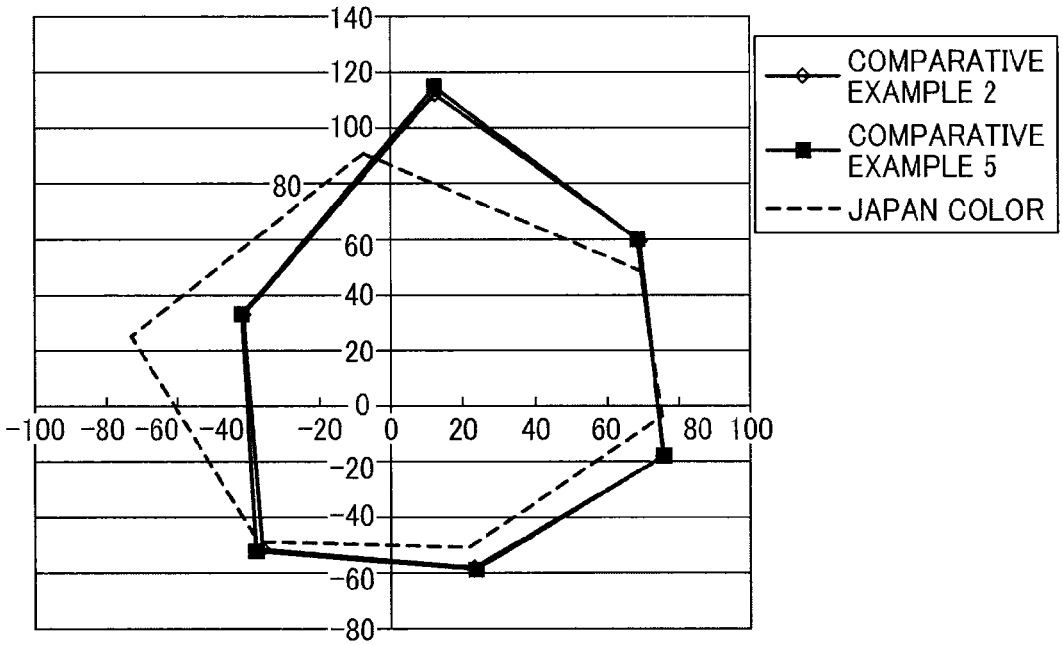
FIG. 5 is a diagram comparing a color reproduction range of a*b* surface of a color image formed by each of developer sets prepared in Comparative Examples 2 and 5 with Japan color.
Figure 6:
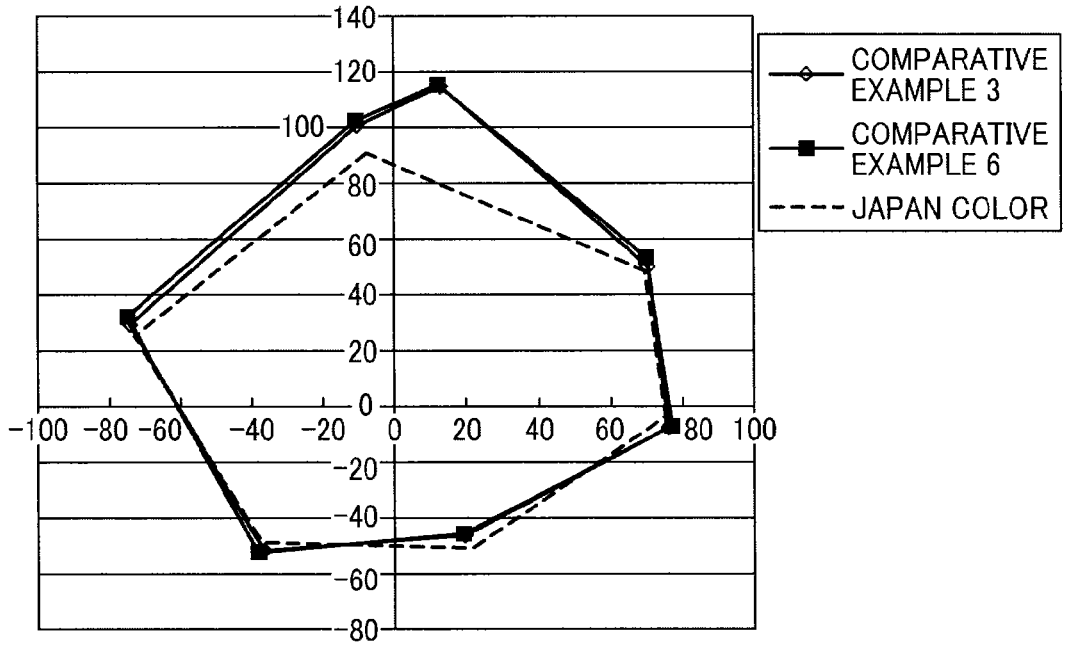
FIG. 6 is a diagram comparing a color reproduction range of a*b* surface of a color image formed by each of developer sets prepared in Comparative Examples 3 and 6 with Japan color.

The fixing speed was 90 mm/sec, a nip width was 15 mm and a nip pressure was 25 N/cm$^2$. Before the color reproduction range was evaluated, the fixing temperature was increased from 100° C. by 10° C. to determine a fixing temperature width from a temperature at which cold offset did not occur to a temperature at which hot offset occurred. The pulverization toner set had the fixing temperature width of from 140 to 180° C., and the chemical toner set from 120 to 230° C. Both of the pulverization toner set and the chemical toner set produced a maximum color reproduction range at 180° C. A coordinate of each color in L*a*b* color system at a fixing temperature of 180° C. is shown in Table 4. Each of FIGS. 1 to 6 shows a color reproduction range of a*b* surface of a color image formed by each of the developer sets prepared in Examples 1 to 6 and Comparative Examples 1 to 6 as a comparison with offset printing standard color reproduction range of Japan color.

The color reproduction range was measured by a spectrodensitometer X-Rite 938 from X-Rite, Inc.

TABLE 4

| | | Y | BY | R | M | B | C | G |
|---|---|---|---|---|---|---|---|---|
| Example 1 | L* | 90.5 | 84.2 | 48.1 | 50.2 | 24.6 | 52.5 | 48.6 |
| | a* | −10.0 | 12.5 | 68.8 | 75.2 | 22.8 | −36.2 | −74.2 |
| | b* | 100.5 | 113.0 | 59.3 | −18.2 | −58.0 | −51.8 | 30.3 |
| | c* | 101.0 | 113.7 | 90.8 | 77.4 | 62.3 | 63.2 | 80.0 |
| | h | 95.7 | 83.7 | 40.8 | 346.4 | 291.5 | 235.1 | 158.0 |
| Example 2 | L* | 89.8 | 84.2 | 48.1 | 50.2 | 24.6 | 52.5 | 48.6 |
| | a* | −7.4 | 12.5 | 68.8 | 75.2 | 22.8 | −36.2 | −74.2 |
| | b* | 101.2 | 113.0 | 59.3 | −18.2 | −58.0 | −51.8 | 30.3 |
| | c* | 101.5 | 113.7 | 90.8 | 77.4 | 62.3 | 63.2 | 80.0 |
| | h | 94.2 | 83.7 | 40.8 | 346.4 | 291.5 | 235.1 | 158.0 |
| Example 3 | L* | 90.5 | 84.2 | 47.6 | 49.7 | 21.4 | 52.5 | 48.6 |
| | a* | −10.0 | 12.5 | 68.9 | 76.4 | 23.0 | −36.2 | −74.2 |
| | b* | 100.5 | 113.0 | 53.8 | −11.0 | −54.1 | −51.8 | 30.3 |
| | c* | 101.0 | 113.7 | 87.4 | 77.2 | 58.8 | 63.2 | 80.0 |
| | h | 95.7 | 83.7 | 38.0 | 351.8 | 293.0 | 235.1 | 158.0 |
| Example 4 | L* | 90.3 | 83.7 | 48.1 | 49.9 | 24.0 | 51.4 | 48.0 |
| | a* | −10.1 | 12.8 | 68.8 | 75.6 | 23.9 | −37.6 | −74.6 |
| | b* | 101.8 | 114.6 | 59.3 | −18.6 | −59.1 | −52.7 | 32.1 |
| | c* | 102.3 | 115.3 | 90.8 | 77.9 | 63.7 | 64.7 | 81.2 |
| | h | 95.7 | 83.6 | 40.8 | 346.2 | 292.0 | 234.5 | 156.7 |
| Example 5 | L* | 90.0 | 83.7 | 48.1 | 49.9 | 24.0 | 51.4 | 48.0 |
| | a* | −7.4 | 12.8 | 68.8 | 75.6 | 23.9 | −37.6 | −74.6 |
| | b* | 102.0 | 114.6 | 59.3 | −18.6 | −59.1 | −52.7 | 32.1 |
| | c* | 102.3 | 115.3 | 90.8 | 77.9 | 63.7 | 64.7 | 81.2 |
| | h | 94.1 | 83.6 | 40.8 | 346.2 | 292.0 | 234.5 | 156.7 |
| Example 6 | L* | 90.3 | 83.7 | 46.6 | 49.2 | 22.4 | 51.4 | 48.0 |
| | a* | −10.1 | 12.8 | 69.4 | 78.0 | 23.2 | −37.6 | −74.6 |
| | b* | 101.8 | 114.6 | 56.8 | −11.6 | −55.6 | −52.7 | 32.1 |
| | c* | 102.3 | 115.3 | 89.7 | 78.9 | 60.2 | 64.7 | 81.2 |
| | h | 95.7 | 83.6 | 39.3 | 351.5 | 292.6 | 234.5 | 156.7 |
| Comparative Example 1 | L* | 90.5 | — | 45.9 | 47.1 | 17.4 | 52.5 | 48.6 |
| | a* | −10.0 | — | 69.9 | 76.2 | 20.1 | −36.2 | −74.2 |
| | b* | 100.5 | — | 50.4 | −7.9 | −46.4 | −51.8 | 30.3 |
| | c* | 101.0 | — | 86.2 | 76.6 | 50.6 | 63.2 | 80.0 |
| | h | 95.7 | — | 35.8 | 354.1 | 293.4 | 235.1 | 158.0 |
| Comparative Example 2 | L* | — | 84.2 | 48.1 | 50.2 | 24.6 | 52.5 | 38.5 |
| | a* | — | 12.5 | 68.8 | 75.2 | 22.8 | −36.2 | −41.0 |
| | b* | — | 113.0 | 59.3 | −18.2 | −58.0 | −51.8 | 32.7 |
| | c* | — | 113.7 | 90.8 | 77.4 | 62.3 | 63.2 | 52.4 |
| | h | — | 83.7 | 40.8 | 346.4 | 291.5 | 235.1 | 141.4 |
| Comparative Example 3 | L* | 90.5 | 83.7 | 45.9 | 47.1 | 17.4 | 52.5 | 48.6 |
| | a* | −10.0 | 12.8 | 69.9 | 76.2 | 20.1 | −36.2 | −74.2 |
| | b* | 100.5 | 114.6 | 50.4 | −7.9 | −46.4 | −51.8 | 30.3 |
| | c* | 101.0 | 115.3 | 86.2 | 76.6 | 50.6 | 63.2 | 80.0 |
| | h | 95.7 | 83.6 | 35.8 | 354.1 | 293.4 | 235.1 | 158.0 |
| Comparative Example 4 | L* | 90.3 | — | 45.0 | 46.2 | 17.4 | 51.3 | 48.0 |
| | a* | −10.1 | — | 70.4 | 77.3 | 20.1 | −37.2 | −74.6 |
| | b* | 101.8 | — | 53.4 | −7.9 | −46.4 | −52.8 | 32.1 |
| | c* | 102.3 | — | 88.4 | 77.7 | 50.6 | 64.6 | 81.2 |
| | h | 95.7 | — | 37.2 | 354.2 | 293.4 | 234.8 | 156.7 |
| Comparative Example 5 | L* | — | 83.7 | 48.1 | 49.9 | 24.0 | 51.4 | 38.5 |
| | a* | — | 12.8 | 68.8 | 75.6 | 23.9 | −37.6 | −41.0 |
| | b* | — | 114.6 | 59.3 | −18.6 | −59.1 | −52.7 | 32.7 |
| | c* | — | 115.3 | 90.8 | 77.9 | 63.7 | 64.7 | 52.4 |
| | h | — | 83.6 | 40.8 | 346.2 | 292.0 | 234.5 | 141.4 |
| Comparative Example 6 | L* | 90.3 | 83.7 | 45.0 | 46.2 | 17.4 | 51.4 | 48.0 |
| | a* | −10.1 | 12.8 | 70.4 | 77.3 | 20.1 | −37.6 | −74.6 |
| | b* | 101.8 | 114.6 | 53.4 | −7.9 | −46.4 | −52.7 | 32.1 |
| | c* | 102.3 | 115.3 | 88.4 | 77.7 | 50.6 | 64.7 | 81.2 |
| | h | 95.7 | 83.6 | 37.2 | 354.2 | 293.4 | 234.5 | 156.7 |
| Japan Color | L* | 87.8 | — | 47.0 | 47.0 | 20.4 | 54.0 | 48.0 |
| | a* | −7.2 | — | 69.0 | 75.5 | 22.1 | −37.3 | −72.8 |
| | b* | 91.1 | — | 48.4 | −3.7 | −51.3 | −48.9 | 24.6 |
| | c* | 91.4 | — | 84.3 | 75.5 | 55.8 | 61.5 | 76.8 |
| | h | 94.5 | — | 35.1 | 357.2 | 293.3 | 232.7 | 161.3 |
| | | Y | BY | R | M | B | C | G |

The toner set of the present invention apparently has good color reproduction range, and color reproducibility of b* of from blue to yellow largely improves in a positive range.

Having now fully described the invention, it will be apparent to one of ordinary skill in the art that many changes and modifications can be made thereto without departing from the spirit and scope of the invention as set forth therein.

What is claimed is:

1. A toner set for electrophotography, comprising:

a black toner;

a yellow toner;

a magenta toner;

a cyan toner; and a bright yellow toner, wherein the magenta toner comprises a magenta colorant mainly comprising C.I. Pigment Red 122, the yellow toner has a hue angle of from 93 to 100° and the bright yellow toner has a hue angle of from 60 to 85° in L*a*b* color system.

2. The toner set for electrophotography of claim 1, wherein the magenta colorant comprises C.I. Pigment Red 122 in an amount not less than 80%.

3. The toner set for electrophotography of claim 1, wherein the bright yellow toner comprises C.I. Pigment Yellow 139 as a colorant and the yellow toner comprises C.I. Pigment Yellow 185 as a colorant.

4. The toner set for electrophotography of claim 1, wherein each of the black toner, the yellow toner, the magenta toner, the cyan toner; and the bright yellow toner is obtained by dissolving and suspending a binder resin mainly comprising polyester, a colorant and a release agent in an organic solvent to prepare a toner composition liquid; and emulsifying or dispersing the toner composition liquid in an aqueous medium.

5. A developer set for electrophotography, comprising each of the black toner, the yellow toner, the magenta toner, the cyan toner; and the bright yellow toner according to claim 1; and a magnetic carrier.

6. An image forming method, comprising:

charging an electrostatic latent image bearer;

irradiating the electrostatic latent image bearer to form an electrostatic latent image thereon;

developing the electrostatic latent image with the toner set according to claim 1 to form a toner image;

transferring the toner image onto a transfer material; and fixing the toner image on the transfer material.

7. An image forming method, comprising:

charging an electrostatic latent image bearer;

irradiating the electrostatic latent image bearer to form an electrostatic latent image thereon;

developing the electrostatic latent image with the developer set according to claim 5 to form a toner image;

transferring the toner image onto a transfer material; and fixing the toner image on the transfer material.

8. The image forming method of claim 6, the yellow toner is used in an area where a* is smaller than yellow toner a* and the bright yellow toner is used in an area where a* is larger than bright yellow toner a* in L*a*b* color system to produce a second color.

* * * * *